US012796800B2

(12) United States Patent
Groat

(10) Patent No.: US 12,796,800 B2
(45) Date of Patent: Nov. 17, 2026

(54) PERSONAL PROTECTIVE VEST WITH COMPONENT ATTACHMENT SYSTEM

(71) Applicant: Safe Life Defense, LLC, Henderson, NV (US)

(72) Inventor: Nick Groat, Henderson, NV (US)

(73) Assignee: Safe Life Defense, LLC, Henderson, NV (US)

( * ) Notice: Subject to any disclaimer, the term of this patent is extended or adjusted under 35 U.S.C. 154(b) by 0 days.

(21) Appl. No.: 19/450,547

(22) Filed: Jan. 15, 2026

(65) Prior Publication Data

US 2026/0206952 A1 Jul. 23, 2026

Related U.S. Application Data

(60) Provisional application No. 63/746,192, filed on Jan. 16, 2025.

(51) Int. Cl.

| | |
|---|---|
| ***A45F 5/00*** | (2006.01) |
| ***A41D 1/04*** | (2006.01) |
| ***A45F 5/02*** | (2006.01) |
| ***F41H 1/02*** | (2006.01) |

(52) U.S. Cl.
CPC ..... *A45F 5/02* (2013.01); *A41D 1/04* (2013.01); *F41H 1/02* (2013.01)

(58) Field of Classification Search
CPC ..... A45F 5/02; A41D 1/04; F41H 1/02
See application file for complete search history.

(56) References Cited

U.S. PATENT DOCUMENTS

| | | | |
|---|---|---|---|
| 4,774,724 | A | 10/1988 | Sacks |
| 9,144,255 | B1 | 9/2015 | Perciballi |
| 2019/0075916 | A1 | 3/2019 | Becker |
| 2024/0374019 | A1 | 11/2024 | Cigard et al. |

FOREIGN PATENT DOCUMENTS

| | | | |
|---|---|---|---|
| WO | 2020/165005 | A1 | 8/2020 |

*Primary Examiner* — Richale L Quinn
(74) *Attorney, Agent, or Firm* — Howard & Howard Attorneys PLLC

(57) ABSTRACT

A personal protective vest assembly is described herein. The personal protective vest assembly includes a component attachment system including a front component attachment panel coupled to a front vest panel and a front component panel removably coupled to the front component attachment panel. The front component attachment panel includes a first hook & loop attachment material and a plurality of attachment slot assemblies defined along the first hook & loop attachment material. The front component panel includes a second hook & loop attachment material and a plurality of retaining tabs. The front component panel is coupled to the front component attachment panel such that each retaining tab is weaved through a corresponding attachment slot assembly and the second hook & loop attachment material of the front component panel is fastened to the first hook & loop attachment material of the front component attachment panel.

20 Claims, 20 Drawing Sheets

PERSONAL PROTECTIVE VEST WITH COMPONENT ATTACHMENT SYSTEM

CROSS REFERENCE TO RELATED APPLICATIONS

The present application claims priority to and all the benefits of U.S. Provisional Patent Application No. 63/746,192, filed on Jan. 16, 2025, the entire contents of which are expressly incorporated herein by reference.

FIELD OF THE INVENTION

This invention relates generally to personal protective vests, and more specifically, to a component attachment system for use with a personal protective vest.

BACKGROUND OF THE INVENTION

At least some known personal protective vests include rigid ballistic panels that are sown into the vest to provide the wearer protection from small arms fire. In addition, at least some known personal protective vests include pockets and/or magazine cartridge holders permanently sown onto the front of the vests. These rigid ballistic panels do not allow for a freedom of movement and a configurable component arrangement that is desired by security personnel to provide additional comfort and flexibility, while providing a high level of safety protection.

The present invention addresses one or more of the aforementioned challenges.

SUMMARY OF THE INVENTION

In one aspect of the present invention, a personal protective vest assembly to be worn by a wearer is provided. The personal protective vest assembly includes a front vest panel adapted to overlay a chest of the wearer, a rear vest panel removably coupled to the front vest panel and adapted to overlay a back of the wearer, and a component attachment system. The component attachment system includes a front component attachment panel coupled to an outer surface of the front vest panel and a front component panel removably coupled to the front component attachment panel. The front component attachment panel includes a front attachment panel body having a substantially rectangular shape extending between a top edge and a bottom edge along a longitudinal axis, and between a first side edge and an opposite second side edge along a transverse axis, a first hook & loop attachment material defined along an outer surface of the front attachment panel body between the top edge, the bottom edge, the first side edge, and the opposite second side edge, and a plurality of attachment slot assemblies defined along the first hook & loop attachment material. Each attachment slot assembly including a pair of positioning slots and a retention slot spaced a distance from the pair of positioning slots along the longitudinal axis. The front component panel includes a component body having a substantially rectangular shape including an attachment side including a second hook & loop attachment material and an opposite outwardly facing component side including at least one equipment component, and a plurality of retaining tabs hingeably coupled to a top portion of the attachment side and spaced along the transverse axis. The front component panel is coupled to the front component attachment panel such that each retaining tab is weaved through a corresponding attachment slot assembly and the second hook & loop attachment material of the front component panel is fastened to the first hook & loop attachment material of the front component attachment panel.

In another aspect of the present invention, a component attachment system for use with a personal protective vest is provided. The component attachment system includes a component attachment panel coupled to an outer surface of the personal protective vest and a component panel removably coupled to the component attachment panel. The component attachment panel includes an attachment panel body having a substantially rectangular shape extending between a top edge and a bottom edge along a longitudinal axis, and between a first side edge and an opposite second side edge along a transverse axis, a first hook & loop attachment material defined along an outer surface of the attachment panel body between the top edge, the bottom edge, the first side edge, and the opposite second side edge, and a plurality of attachment slot assemblies defined along the first hook & loop attachment material. Each attachment slot assembly includes a pair of positioning slots and a retention slot spaced a distance from the pair of positioning slots along the longitudinal axis. The component panel includes a component body having a substantially rectangular shape including an attachment side including a second hook & loop attachment material and an opposite outwardly facing component side including at least one equipment component, and a plurality of retaining tabs hingeably coupled to a top portion of the attachment side and spaced along the transverse axis. The component panel is coupled to the component attachment panel such that each retaining tab is weaved through a corresponding attachment slot assembly and the second hook & loop attachment material of the component panel is fastened to the first hook & loop attachment material of the component attachment panel.

BRIEF DESCRIPTION OF THE DRAWINGS

Other advantages of the present invention will be readily appreciated as the same becomes better understood by reference to the following detailed description when considered in connection with the accompanying drawings wherein.

Corresponding reference characters indicate corresponding parts throughout the drawings.

DETAILED DESCRIPTION OF THE INVENTION

Figure 1:
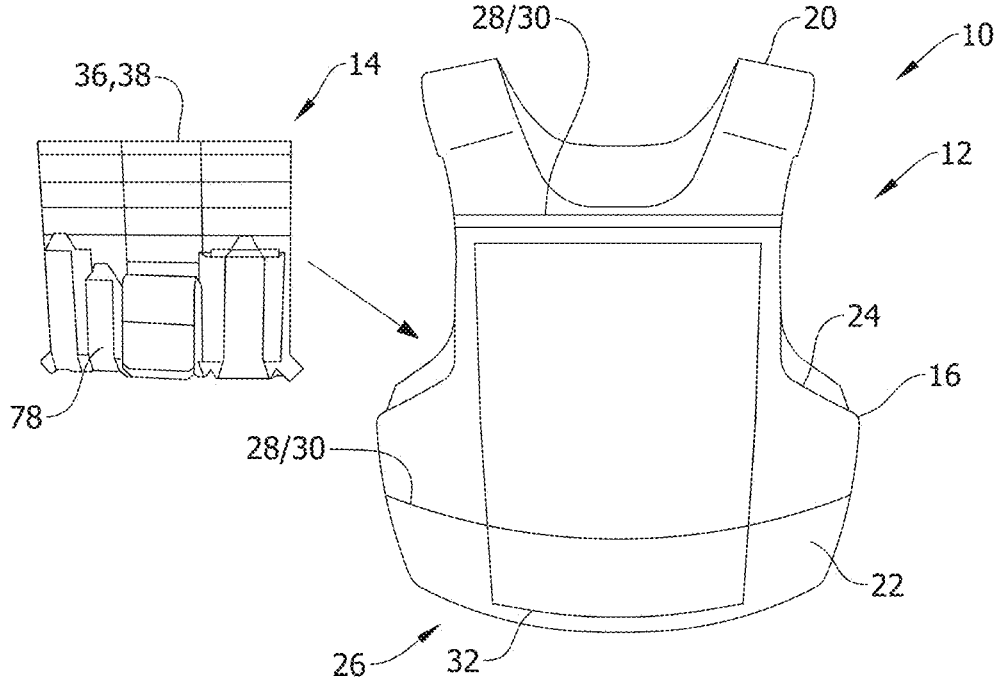
FIGS. 1-4 are perspective views of a personal protective vest assembly including a component attachment system.
Figure 2:
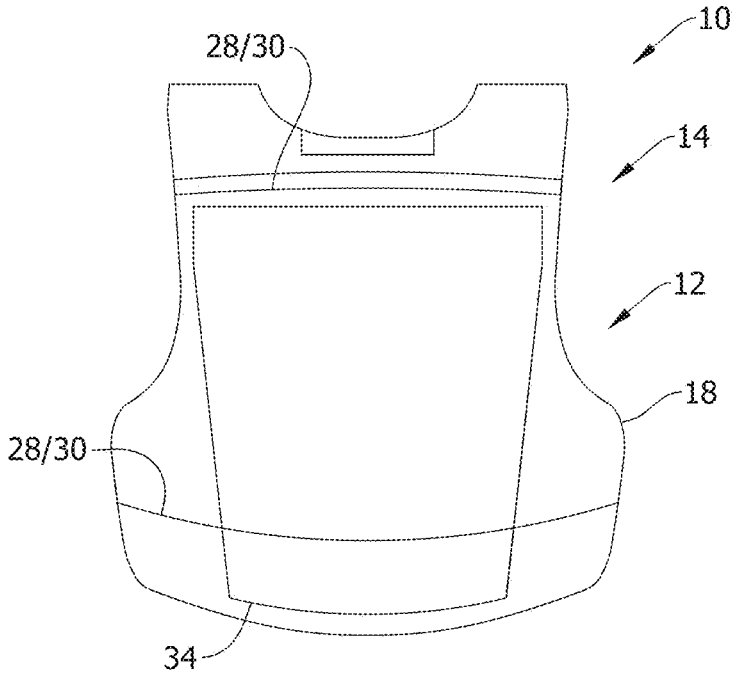
Figure 3:
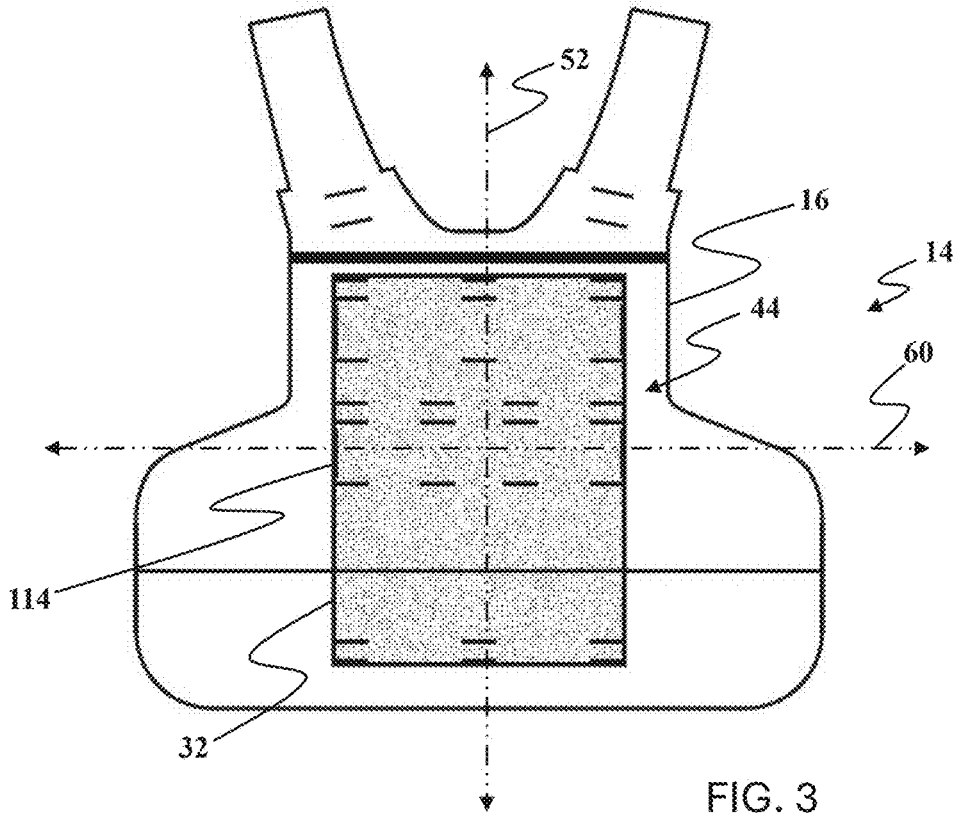
Figure 4:
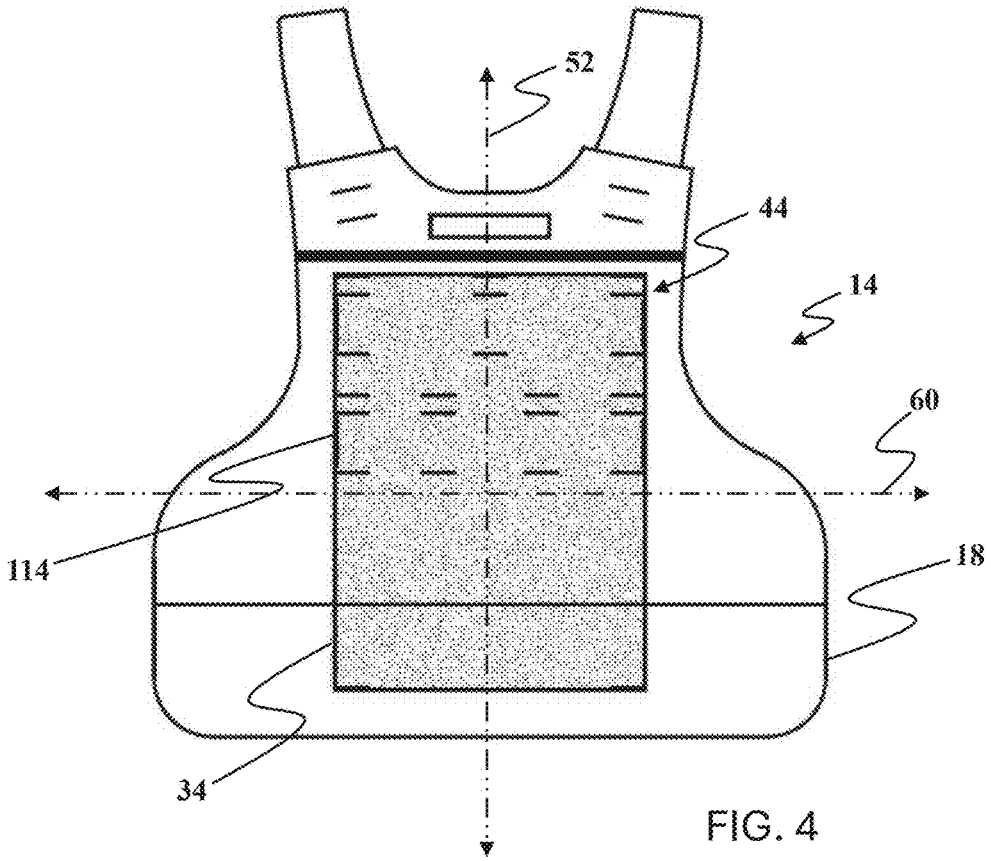
Figure 5:
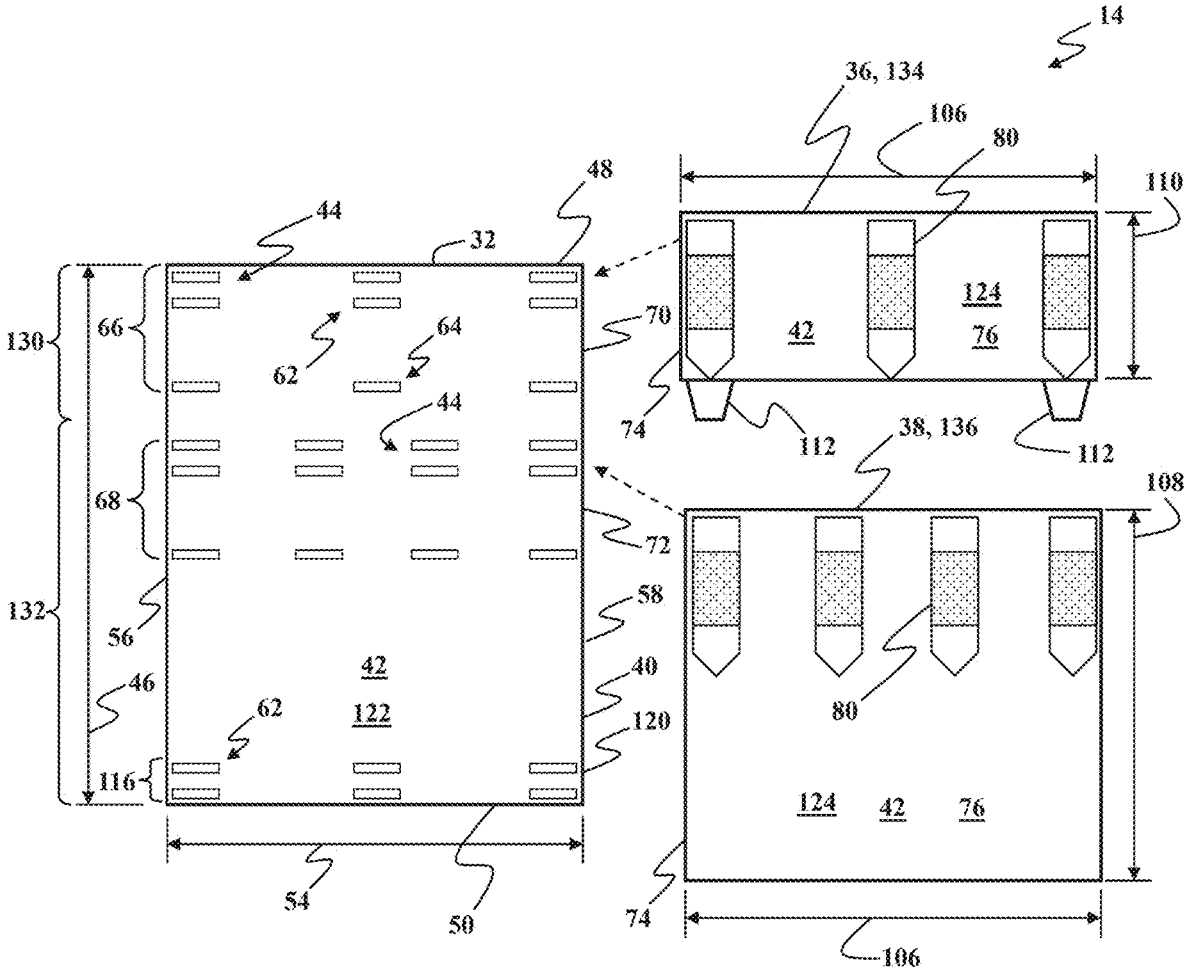
FIGS. 5-10 are schematic views of the component attachment system shown in FIGS. 1-4.
Figure 6:
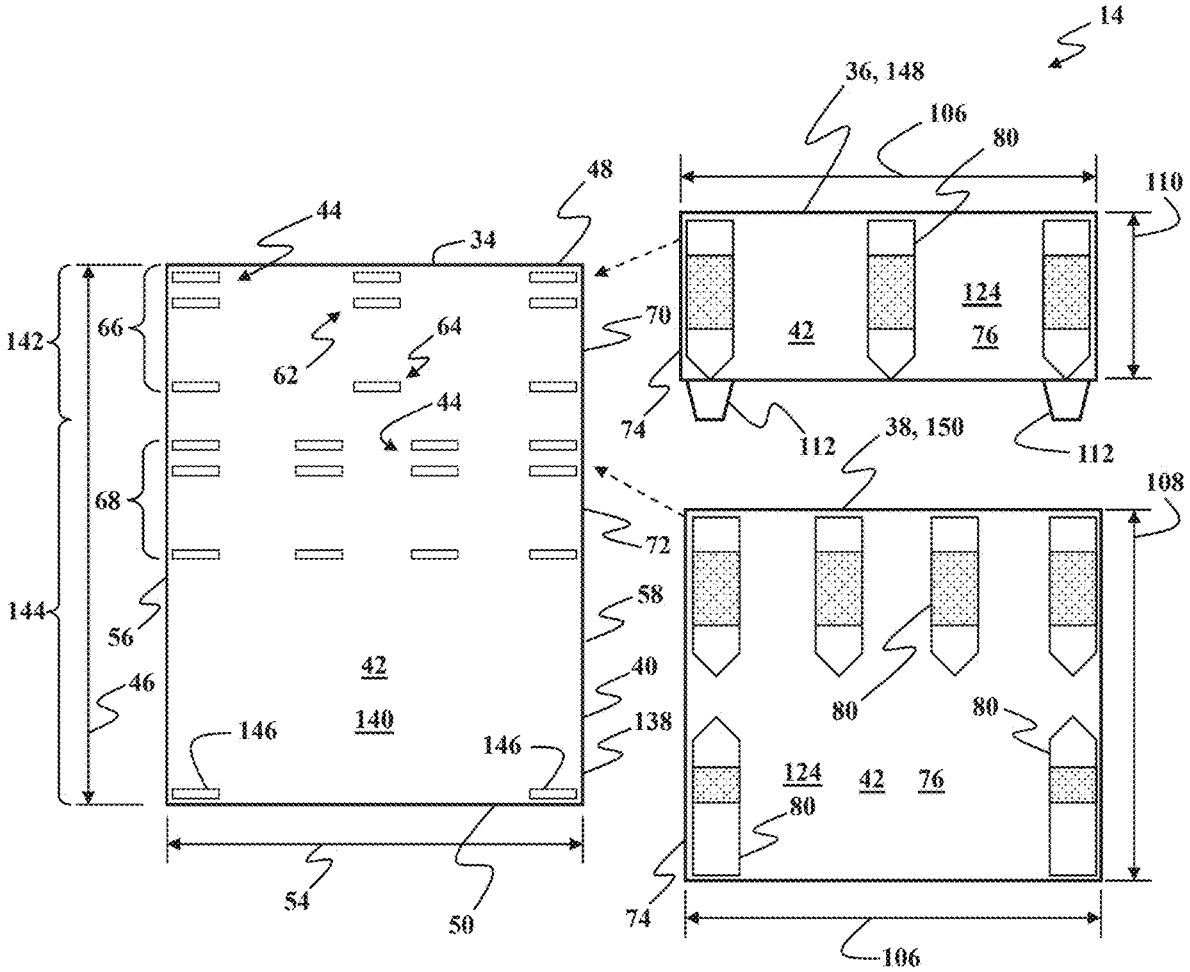
Figure 7:
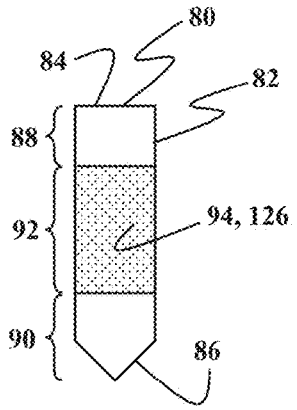
Figure 8:
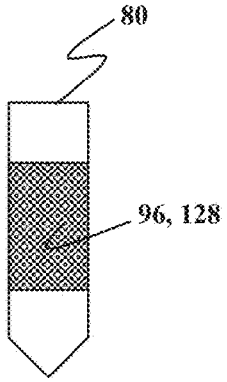

In the following description, numerous specific details are set forth in order to provide a thorough understanding of the present invention. For example, the dimensions of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention. It will be apparent, however, to one having ordinary skill in the art that the specific detail need not be employed to practice the present invention. In other instances, well-known materials or methods have not been described in detail in order to avoid obscuring the present invention.

In general, the present invention describes a personal protective vest system that includes a component attachment system that enables various components to be removably attached to the personal protective vest to allow a user to customize the personal protective vest for their needs. In some embodiments, the personal protective vest system includes the Unity Hybrid Armor System™ provided by Safe Life Defense™.

Referring to FIGS. 1-14, in the illustrated embodiment, the present invention includes a personal protective vest assembly 10 that includes a wearable personal protective vest 12, one or more body armor panels removably inserted into the personal protective vest 12, and a component attachment system 14. The personal protective vest 12 is configured to be worn by a person covering a portion of the person's torso. In other embodiments, the personal protective vest assembly 10 may include other wearable protective articles that cover other areas of a person's body such as, for example, wearable protective articles covering the lower body, arms, legs, and head.

In the illustrated embodiment, the personal protective vest 12 includes a front vest panel 16 adapted to overlay a chest of the wearer and a rear vest panel 18 adapted to overlay a back of the wearer. In some embodiments, the front vest panel 16 may be removably coupled to the rear vest panel 18 with a vest fastening assembly 20. The vest fastening assembly 20 may include, for example, hook & loop attachment material such as Velcro®, a button assembly, and/or any suitable fasteners that allow the front vest panel 16 to removably attach to the rear vest panel 18.

Each vest panel 16, 18 includes an outer surface 22 and an inner surface 24 adapted to be positioned adjacent to the person's body when the personal protective vest 12 is worn by the person. A ballistic panel pocket 26 is defined between the outer surface 22 and the inner surface 24. The ballistic panel pocket 26 is sized and shaped to receive a body armor panel therein such that the body armor panel is positioned within the ballistic panel pocket 26. The outer surface 22 also includes an armor panel slot 28 defined along a lower portion of the outer surface 22 to provide access to the ballistic panel pocket 26 to insert and/or remove the body armor panel. A slot fastening assembly 30 may be defined along the armor panel slot 28 to allow the ballistic panel pocket 26 to be selectively sealed. The slot fastening assembly 30 may include, for example, a Velcro® assembly, a button fastener assembly, and/or any suitable fasteners that allow armor panel slot 28 and ballistic panel pocket 26 to be sealed. In some embodiments, the vest panel 16, 18 may also include a ballistic panel pocket 26 for receiving a second armor panel therein, and a second armor panel slot 28 defined along a top portion of the outer surface 22 to provide access to the ballistic panel pocket 26. The second armor panel slot 28 may also include a Velcro® and/or zipper fastening assembly that allow the second armor panel slot 28 and ballistic panel pocket 26 to be selectively sealed.

In the illustrated embodiment, the component attachment system 14 includes a front component attachment panel 32 coupled to the outer surface of the front vest panel 16, a rear component attachment panel 34 coupled to an outer surface of the rear vest panel 18, and a plurality of interchangeable component panels 36, 38 that are removably coupled to the component attachment panels 32, 34. Each component attachment panel 32, 34 includes a panel body 40, hook & loop attachment material 42 defined along an outer surface of the panel body 40, and a plurality of attachment slot assemblies 44 defined along the hook & loop attachment material 42.

The panel body 40 includes a substantially rectangular shape having a length 46 defined between a top edge 48 and a bottom edge 50 along a longitudinal axis 52, and a width 54 defined between a first side edge 56 and an opposite second side edge 58 along a transverse axis 60.

Each attachment slot assembly 44 includes a pair of positioning slots 62 and a retention slot 64 spaced a distance from the pair of positioning slots 62. The attachment slot assemblies 44 are arranged in a first set 66 of attachment slot assemblies 44 and a second set 68 of attachment slot assemblies 44 spaced a distance from the first set 66 along the longitudinal axis 52. The first set 66 of attachment slot assemblies 44 are defined along an upper portion 70 of the panel body 40 and are evenly spaced between the first side edge 56 and the second side edge 58 along the transverse axis 60. The second set 68 of attachment slot assemblies 44 are defined along a lower portion 72 of the panel body 40 and are evenly spaced between the first side edge 56 and the second side edge 58 along the transverse axis 60. In the illustrated embodiment, the first set 66 of attachment slot assemblies 44 includes three attachment slot assemblies 44 spaced along the upper portion 70 of the panel body 40 and the second set 68 of attachment slot assemblies 44 includes four attachment slot assemblies 44 spaced along the lower portion 72 of the panel body 40.

Each component panel 36, 38 includes a substantially rectangularly shaped component body 74 defining an attachment side 76 and an opposite component side 78, hook & loop attachment material 42 defined along the attachment side 76 of the component body 74, and a plurality of retaining tabs 80 hingeably coupled to a top portion of the attachment side 76 of the component body 74. The attachment side 76 is configured to attach to the component attachment panels 32, 34 such that the component side 78 is outwardly facing from the vest panel 16, 18. The component side 78 supports various equipment components such as, for example, magazine pouches, flashlight pouches, pockets, badge holders, Velcro® sections, Molle™ attachments, and the like.

The hook & loop attachment material 42 of the component panel 36, 38 is configured to attached to the corresponding hook & loop attachment material 42 of the component attachment panels 32, 34 to facilitate coupling the component panels 36, 38 to the component attachment panels 32, 34. In addition, each retaining tab 80 is sized and shaped to be weaved through a corresponding attachment slot assembly 44 to facilitate coupling the component panels 36, 38 to the component attachment panels 32, 34.

Each retaining tab 80 includes a semi-rigid tab body 82 formed from thermoplastic composite material extending between a top end 84 and a bottom end 86 and defining a positioning section 88 adjacent the top end 84, and locking section 90 adjacent the bottom end 86, and an attachment section 92 defined between the positioning section 88 and the locking section 90. For example, the semi-rigid tab body 82 may be formed from Tegris® and/or Curv® polypropylene (PP) tape woven into fabric. The top end 84 is hingeably coupled to a top portion of the component body 74 such that the retaining tab 80 extends towards a bottom portion of the component body 74 along the longitudinal axis 52. The attachment section 92 includes hook & loop attachment material 42 defined along each side of the attachment section 92 to facilitate coupling the component panel 36, 38 to the component attachment panels 32, 34. For example, as shown in FIGS. 7-10, the retaining tab 80 includes a first side 94 of the hook & loop attachment material 42 defined along the outer surface of the attachment section 92 to facilitate coupling the attachment section 92 to the hook & loop attachment material 42 of the component attachment panels 32, 34, and includes a second side 96 of the hook & loop attachment material 42 defined along the inner surface of the attachment section 92 to facilitate coupling the attachment section 92 to the hook & loop attachment material 42 of the component panel 36, 38.

Figure 9:
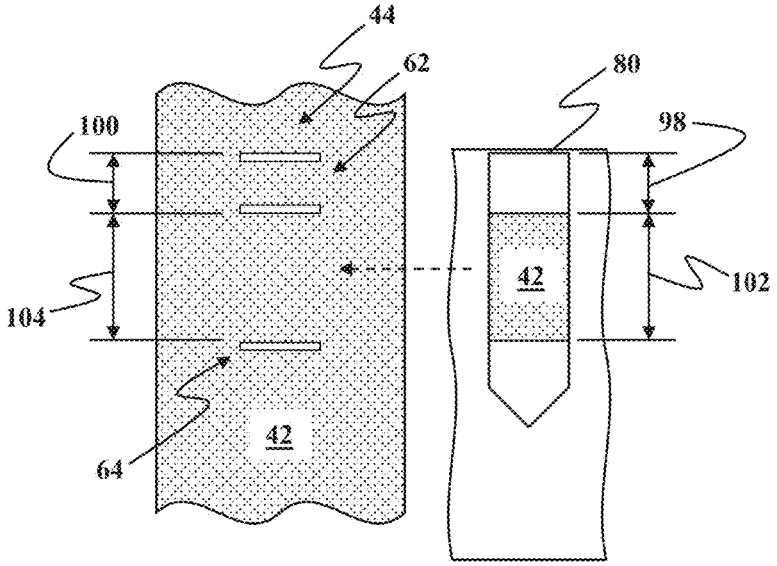
Figure 10:
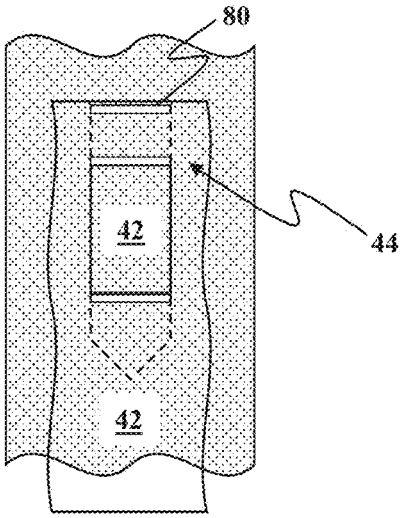

As shown in FIG. 9, the positioning section 88 includes a length 98 that is substantially equal to a distance 100 defined between the pair of positioning slots 62, and the attachment section 92 includes a length 102 that is substantially equal to a distance 104 defined between the pair of positioning slots 62 and the retention slot 64.

The component attachment system 14 includes upper component panels 36 that are configured to attach to the upper portion 70 of the component attachment panel 32, 34 and lower component panels 38 that are configured to attach to the lower portion 72 of the component attachment panel 32, 34. The upper component panel 36 and the lower component panels 38 each have the same width 106 defined along the transverse axis 60, which is the same width as the width 54 of component attachment panel 32, 34. The lower component panel 38 includes a length 108 defined along the longitudinal axis 52 that is longer than the length 110 of the upper component panel 36. When the upper and lower component panels 36, 38 are attached to the component attachment panel 32, 34, the upper and lower component panels 36, 38 overlay the entire length 46 and width 54 of the component attachment panel 32, 34.

The lower component panel 38 includes four retaining tabs 80 that are spaced equally along the transverse axis 60 and correspond to the four attachment slot assemblies 44 included in the second set 68 of attachment slot assemblies 44.

The upper component panel 36 includes three retaining tabs 80 that are spaced equally along the transverse axis 60 and correspond to the three attachment slot assemblies 44 included in the first set 66 of attachment slot assemblies 44. The upper component panel 36 may also include a pair of locking tabs 112 extending from the bottom edge of the component body 74. Each locking tab 112 is configured to be inserted through a corresponding positioning slot 62 of the second set 68 of attachment slot assemblies 44.

During assembly, each retaining tab 80 is woven through a corresponding attachment slot assembly 44 such that the positioning section 88 is positioned underneath the hook & loop attachment material 42 of the component attachment panels 32, 34 between the positioning slots 62, and the attachment section 92 overlays on top of the hook & loop attachment material 42 of the component attachment panels 32, 34 between the positioning slots 62 and the retention slot 64. The locking section 90 is then inserted underneath the hook & loop attachment material 42 of the component attachment panels 32, 34 through the retention slot 64.

In some embodiments, the component attachment panels 32, 34 may include one or more cable slits 114 defined along the side edges of the panel body 40 to facilitate routing power and communication cables throughout the vest panel. The front component attachment panel 32 may also include an additional set 116 of three pairs of positioning slots 62 defined along the bottom edge of the panel body 40 to facilitate coupling additional component panels to the bottom edge of the panel body 40.

Referring to FIGS. 11-31 In some embodiments, the component attachment system 14 includes a front vest component attachment assembly 116 coupled to the front vest panel 16 and a rear vest component attachment assembly 118 coupled to the rear vest panel 18.

The front vest component attachment assembly 116 includes the front component attachment panel 32 coupled to the outer surface of the front vest panel 16 and at least one front component panel 36, 38 removably coupled to the front component attachment panel 32.

The front component attachment panel 32 includes a front attachment panel body 120 (e.g. panel body 40), a first hook & loop attachment material 122, and a plurality of attachment slot assemblies 44. The front attachment panel body 120 includes substantially rectangular shape extending between the top edge 48 and the bottom edge 50 along the longitudinal axis 52, and between the first side edge 56 and the opposite second side edge 58 along the transverse axis 60. The first hook & loop attachment material 122 is defined along an outer surface of the front attachment panel body 120 between the top edge 48, the bottom edge 50, the first side edge 56, and the opposite second side edge 58. The plurality of attachment slot assemblies 44 are defined along the first hook & loop attachment material 122. Each attachment slot assembly 44 includes the pair of positioning slots 62 and the retention slot 64 spaced a distance from the pair of positioning slots 62 along the longitudinal axis 52.

The front component panel 36, 38 includes a component body 74 and a plurality of retaining tabs 80. The component body 74 has a substantially rectangular shape including an attachment side 76 including a second hook & loop attachment material 124, and an opposite outwardly facing component side 78 including at least one equipment component. The plurality of retaining tabs 80 are hingeably coupled to a top portion of the attachment side 76 and spaced along the transverse axis 60.

As shown in FIGS. 9-10, 19-20, and 24-25, the front component panel 36, 38 is coupled to the front component attachment panel 32 such that each retaining tab 80 is weaved through a corresponding attachment slot assembly 44 and the second hook & loop attachment material 124 of the front component panel 36, 38 is fastened to the first hook & loop attachment material 122 of the front component attachment panel 32.

For example, as shown in FIGS. 7-10, in the illustrated embodiment, each retaining tab 80 includes the semi-rigid tab body 82 extending along the longitudinal axis 52 between the top end 84 and the bottom end 86 defining the positioning section 88 adjacent the top end 84, the locking section 90 adjacent the bottom end 86, and the attachment section 92 defined between the positioning section 88 and the locking section 90.

The retaining tab 80 also includes a third hook & loop attachment material 126 defined along an outer surface 94 of the attachment section 92 and a fourth hook & loop attachment material 128 defined along an inner surface 96 of the attachment section 92. The third hook & loop attachment material 126 is sized and shaped to couple the attachment section 92 to the first hook & loop attachment material 122 of the front component attachment panel 32. The fourth hook & loop attachment material 128 is sized and shaped to couple the attachment section 92 to the second hook & loop attachment material 124 of the front component panel 36, 38. The retaining tab 80 is sized and shaped to be weaved through a corresponding attachment slot assembly 44 such that the positioning section 88 is orientated adjacent the pair of positioning slots 62 underneath the front component attachment panel 32, the attachment section 92 is orientated between the pair of positioning slots 62 and the retention slot 64 such that the third hook & loop attachment material 126 fastens to the first hook & loop attachment material 122 of the front component attachment panel 32 and the fourth hook & loop attachment material 128 fastens to the second hook & loop attachment material 124 of the front component panel 36, 38, and the locking section 90 is inserted through the retention slot 64 and orientated underneath the front component attachment panel 32. The locking section 90 may include a trapezoidal and/or triangular shape to facilitate inserting the retaining tab 80 through the attachment slot assembly 44.

In the illustrated embodiment, the component attachment system 14 includes a Zone A attachment area 130 defined along an upper portion of the front attachment panel body 120 and a Zone B attachment area 132 defined along a lower portion of the front attachment panel body 120. The Zone A attachment area 130 includes a first group 66 of attachment slot assemblies 44 including three attachment slot assemblies 44 spaced along the transverse axis 60, and the Zone B attachment area includes a second group 68 of attachment slot assemblies 44 including four attachment slot assemblies 44 spaced along the transverse axis 60.

The component attachment system 14 also includes a Zone A front component panel 134 (e.g. component panel 36) that is removably coupled to the Zone A attachment area 130 and a Zone B front component panel 136 (e.g. component panel 38) that is removably coupled to the Zone B attachment area 132.

The Zone A front component panel 134 includes three retaining tabs 80 corresponding to the three attachment slot assemblies 44 of the Zone A attachment area 130. The Zone A front component panel 134 also includes a pair of locking tabs 112 extending from a bottom portion of the component body that are sized and shaped to be inserted through corresponding positioning slots 62 of the second group of attachment slot assemblies 44 of the Zone B attachment area 132. For example, the locking tabs 112 may include a trapezoidal and/or triangular shape to facilitate inserting the locking tabs 112 through the attachment slot assemblies 44.

The Zone B front component panel 136 includes four retaining tabs 80 corresponding to the four attachment slot assemblies 44 of the Zone B attachment area 132.

In the illustrated embodiment, the Zone A front component panel 134 and the Zone B front component panel 136 each have a component width 106 defined along the transverse axis 60 that is substantially equal to a width 54 of the front component attachment panel 32. In addition, the Zone A front component panel 134 has a first component length 110 defined along the longitudinal axis 52, and the Zone B front component panel 136 has a second component length 108 defined along the longitudinal axis 52 that is longer than the first component length 110 of the Zone A front component panel 134.

Figure 11:
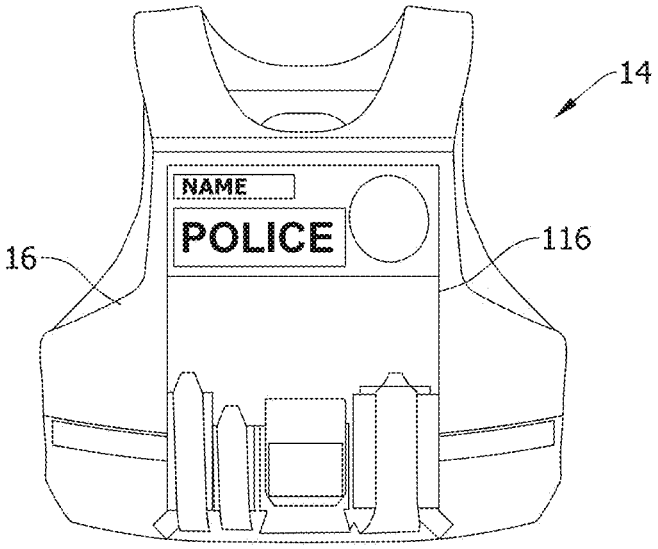
FIG. 11 is a perspective view of a front vest panel of the personal protective vest assembly including the component attachment system.
Figure 12:
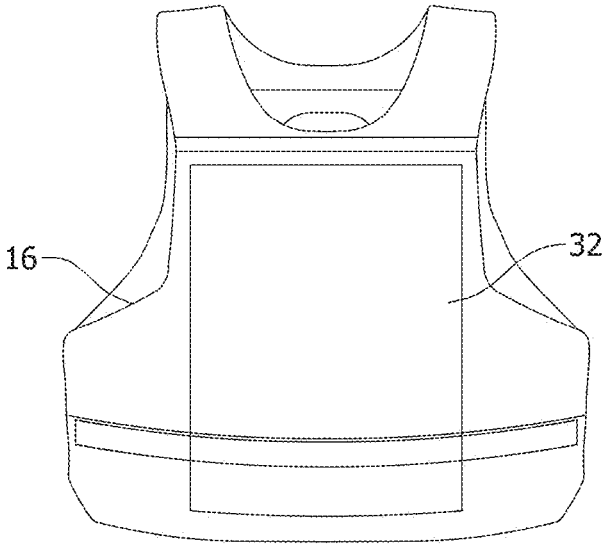
FIG. 12 is a perspective view of the front vest panel shown in FIG. 11 with the front component panels of the component attachment system removed.

As shown in FIG. 11, when fastened to the front component attachment panel 32, the Zone A front component panel 134 and the Zone B front component panel 136 overlay a full extent of the front component attachment panel 32.

The rear vest component attachment assembly 118 includes a rear component attachment panel 34 coupled to an outer surface of the rear vest panel 18. The rear component attachment panel 34 includes a rear attachment panel body 138 (e.g. panel body 40) having a substantially rectangular shape and a rear hook & loop attachment material 140 defined along an outer surface of the rear attachment panel body 138.

The rear component attachment panel 34 includes a Zone C attachment area 142 defined along an upper portion of the rear attachment panel body 138 including three attachment slot assemblies 44 spaced along the transverse axis 60, and a Zone D attachment area 144 defined along a lower portion of the rear attachment panel body 138 and including four attachment slot assemblies 44 spaced along the transverse axis 60. The rear component attachment panel 34 also includes a pair of lower rear panel retention slots 146 defined along a bottom edge of the rear hook & loop attachment material 140.

The rear vest component attachment assembly 118 also includes a Zone C rear component panel 148 (e.g. component panel 36) that is removably coupled to the Zone C attachment area 142 and a Zone D rear component panel 150 (e.g. component panel 38) that is removably coupled to the Zone D attachment area 144.

The Zone C rear component panel 148 includes three retaining tabs 80 corresponding to the three attachment slot assemblies 44 of the Zone C attachment area 142. The Zone D rear component panel 150 includes four retaining tabs 80 corresponding to the four attachment slot assemblies 44 of the Zone D attachment area 144. The Zone D rear component panel 150 also includes a pair of lower retaining tabs 80 that hingeably coupled to a bottom end of the Zone D rear component panel 150 and are sized and shaped to be inserted through the pair of lower rear panel retention slots 146.

The Zone C rear component panel 148 and the Zone D rear component panel 150 each have a component width 106 defined along the transverse axis 60 that is substantially equal to a width 54 of the rear component attachment panel 34.

The Zone C rear component panel 148 also has a first component length 110 defined along the longitudinal axis 52, and the Zone D rear component panel 150 has a second component length 108 defined along the longitudinal axis 52 that is longer than the first component length 110 of the Zone C rear component panel 148.

Figure 13:
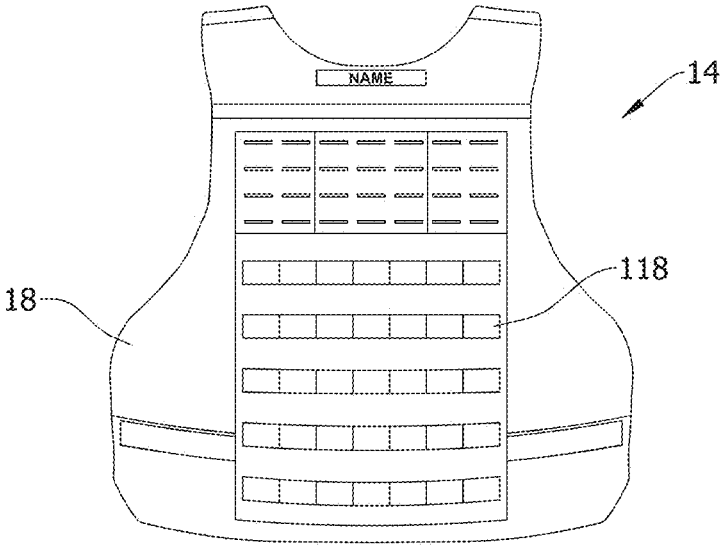
FIG. 13 is a perspective view of a rear vest panel of the personal protective vest assembly including the component attachment system.
Figure 14:
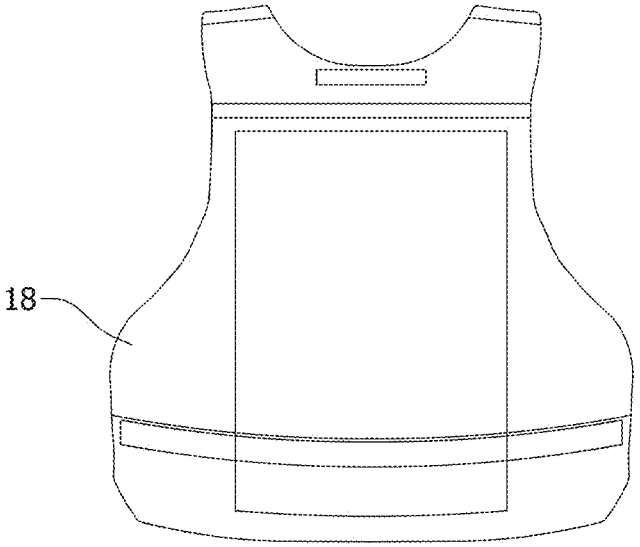
FIG. 14 is a perspective view of the rear vest panel shown in FIG. 13 with the rear component panels of the component attachment system removed.
Figure 15:
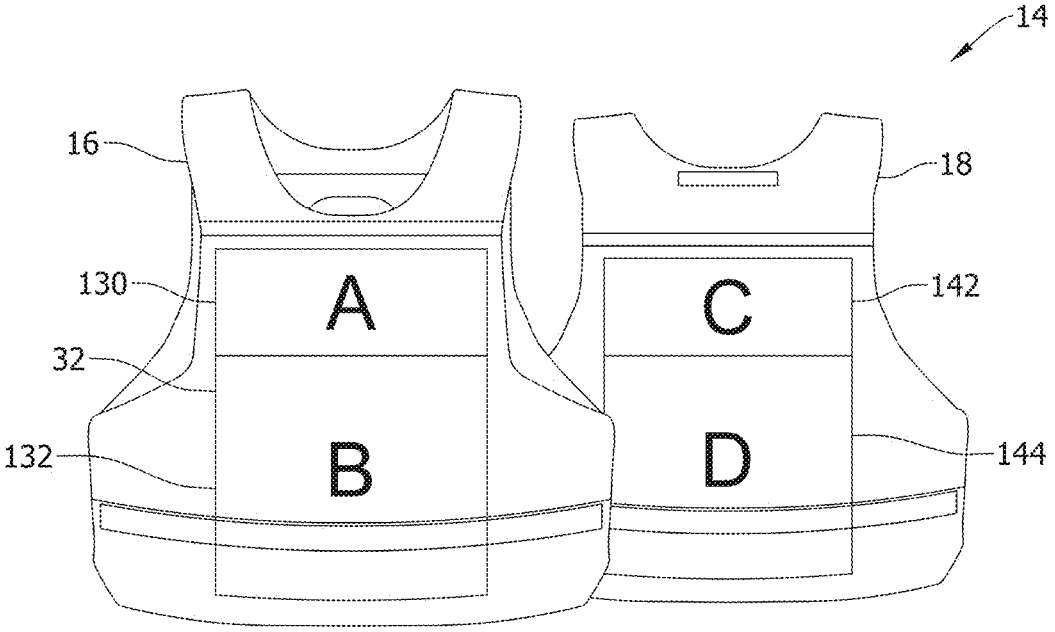
FIG. 15 is a perspective view of the front component attachment panel illustrating Zone A and Zone B attachment areas and the rear component attachment panel illustrating Zone C and Zone D attachment areas.
Figure 16:
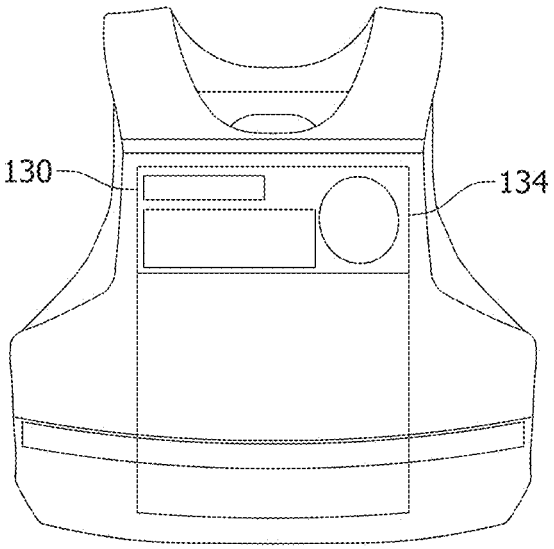
FIG. 16 is a partial perspective view of the front vest panel with a Zone A front component panel attached to the Zone A attachment area.
Figure 17:
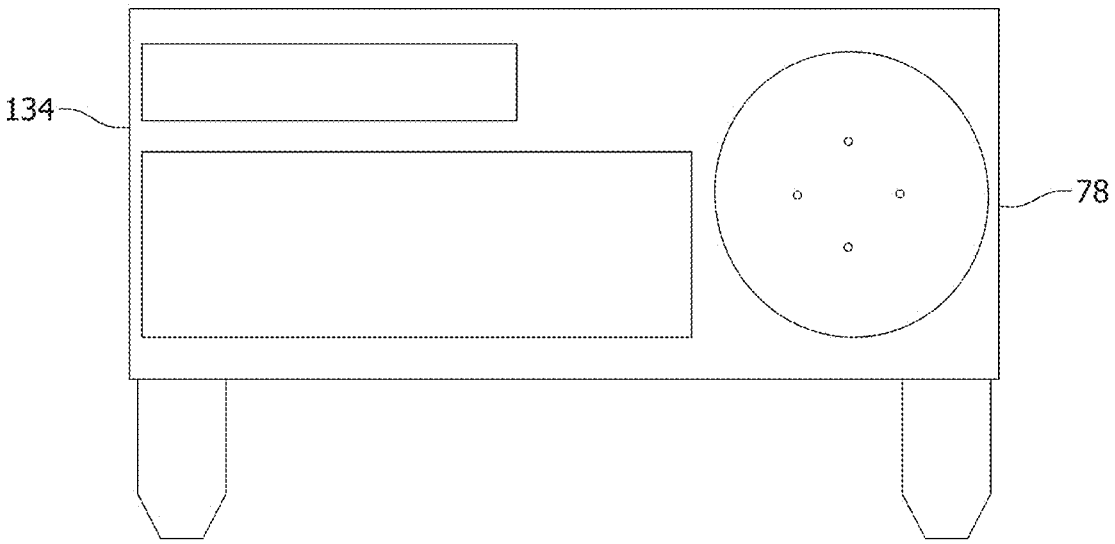
FIG. 17 is front view of a Zone A front component panel.
Figure 18:
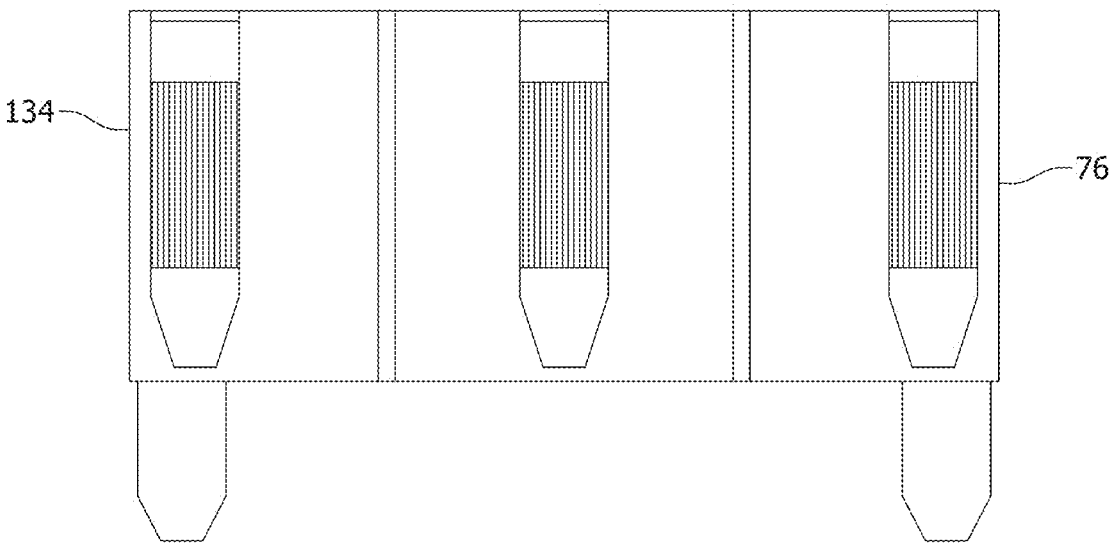
FIG. 18 is rear view of the Zone A front component panel.
Figure 19:
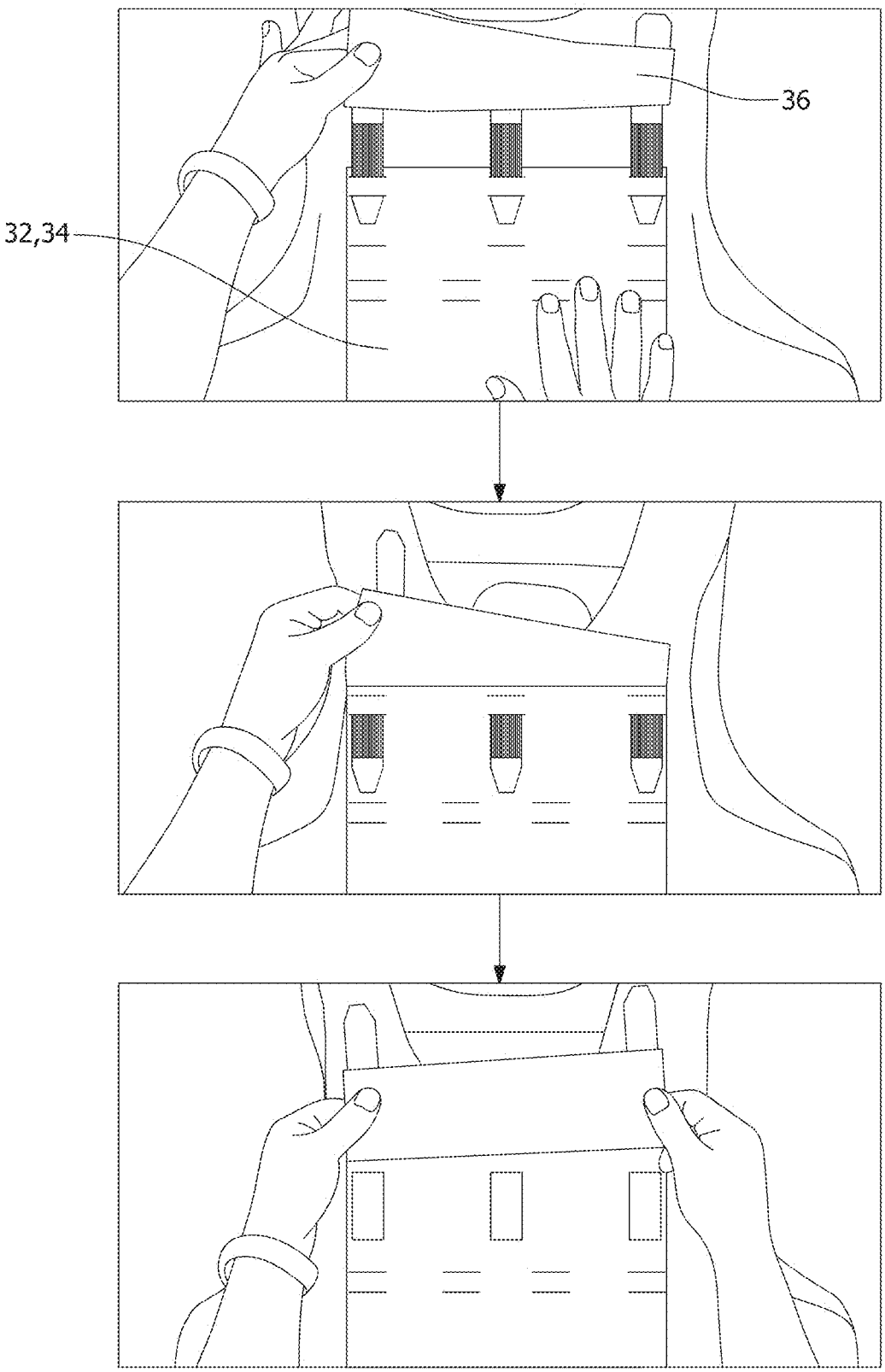
FIGS. 19 and 20 are illustrations of a method of attaching a Zone A front component panel to the Zone A attachment area.
Figure 20:
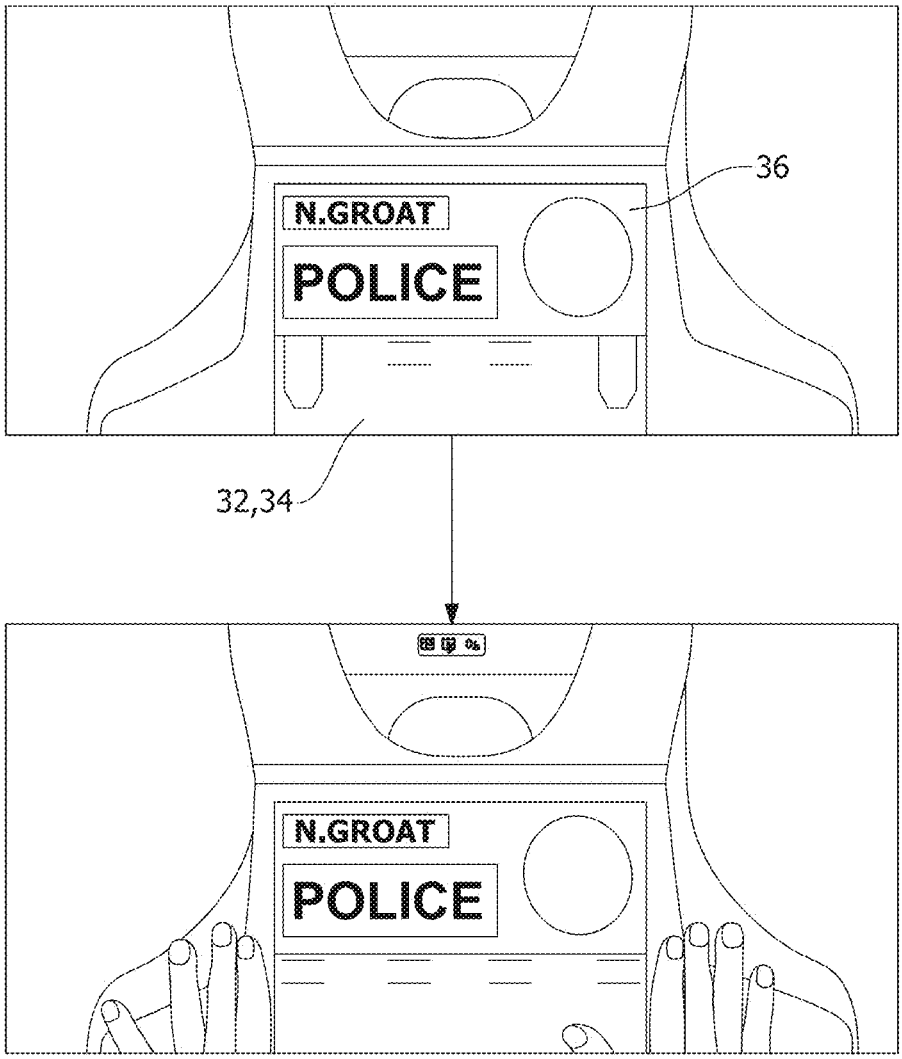
Figure 21:
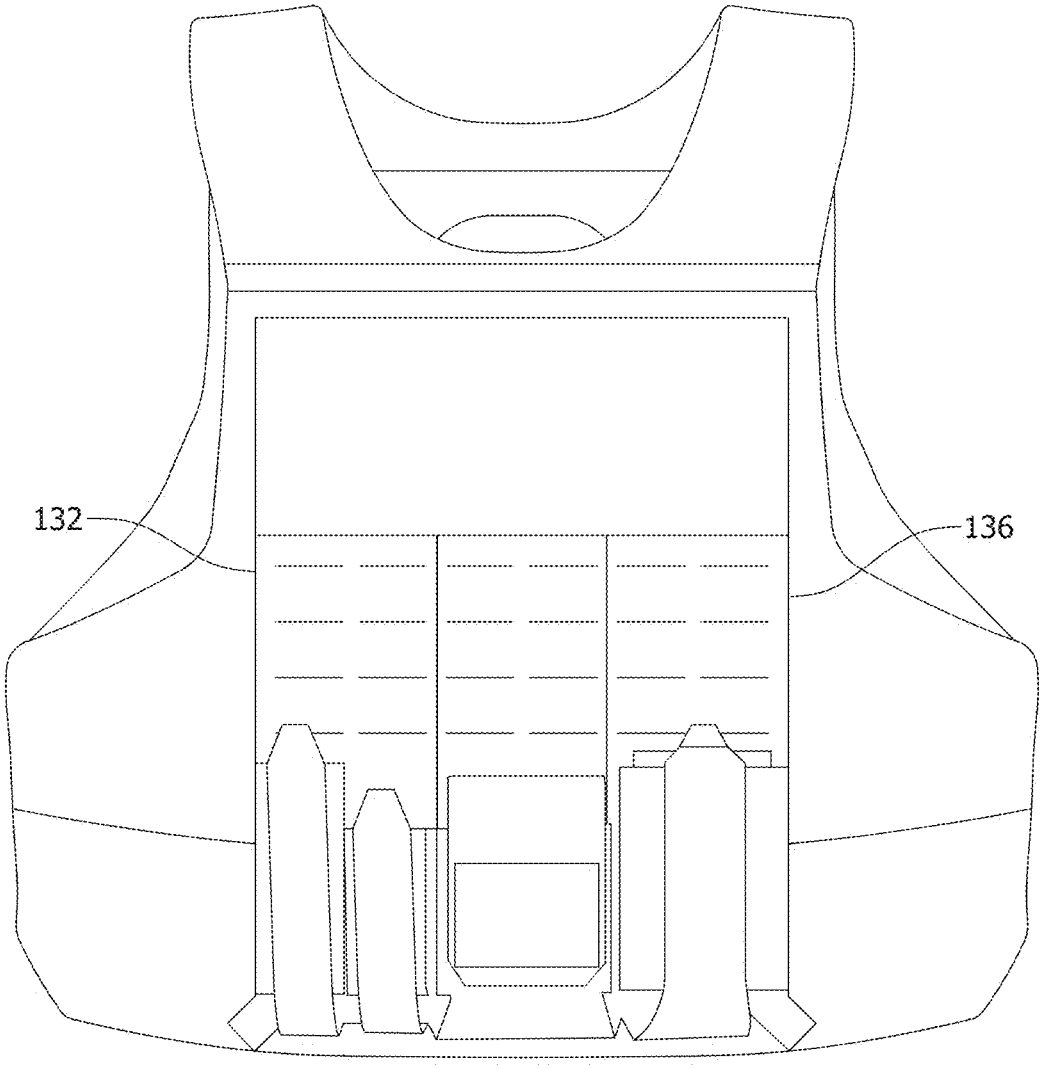
FIG. 21 is a partial perspective view of the front vest panel with a Zone B front component panel attached to the Zone B attachment area.
Figure 22:
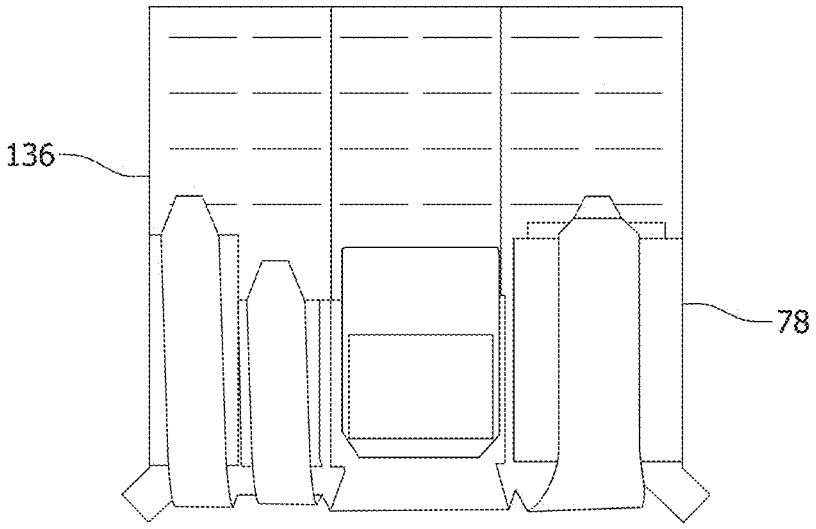
FIG. 22 is front view of a Zone B front component panel.
Figure 23:
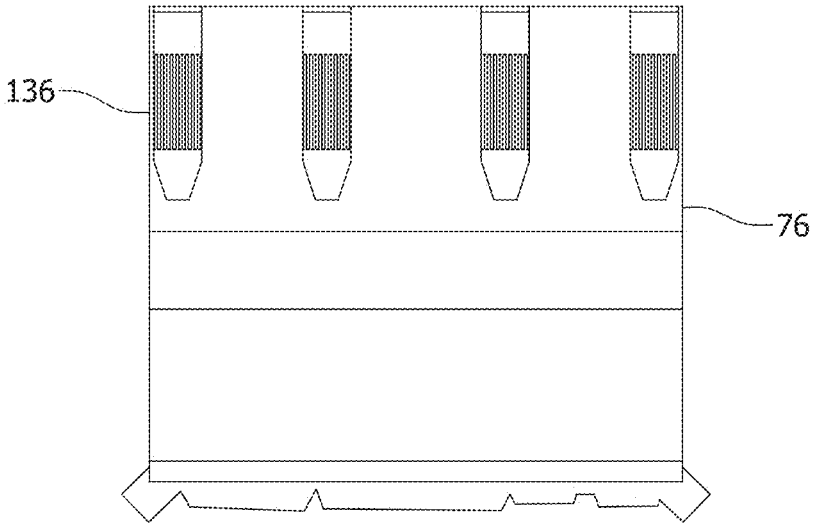
FIG. 23 is rear view of the Zone B front component panel.
Figure 24:
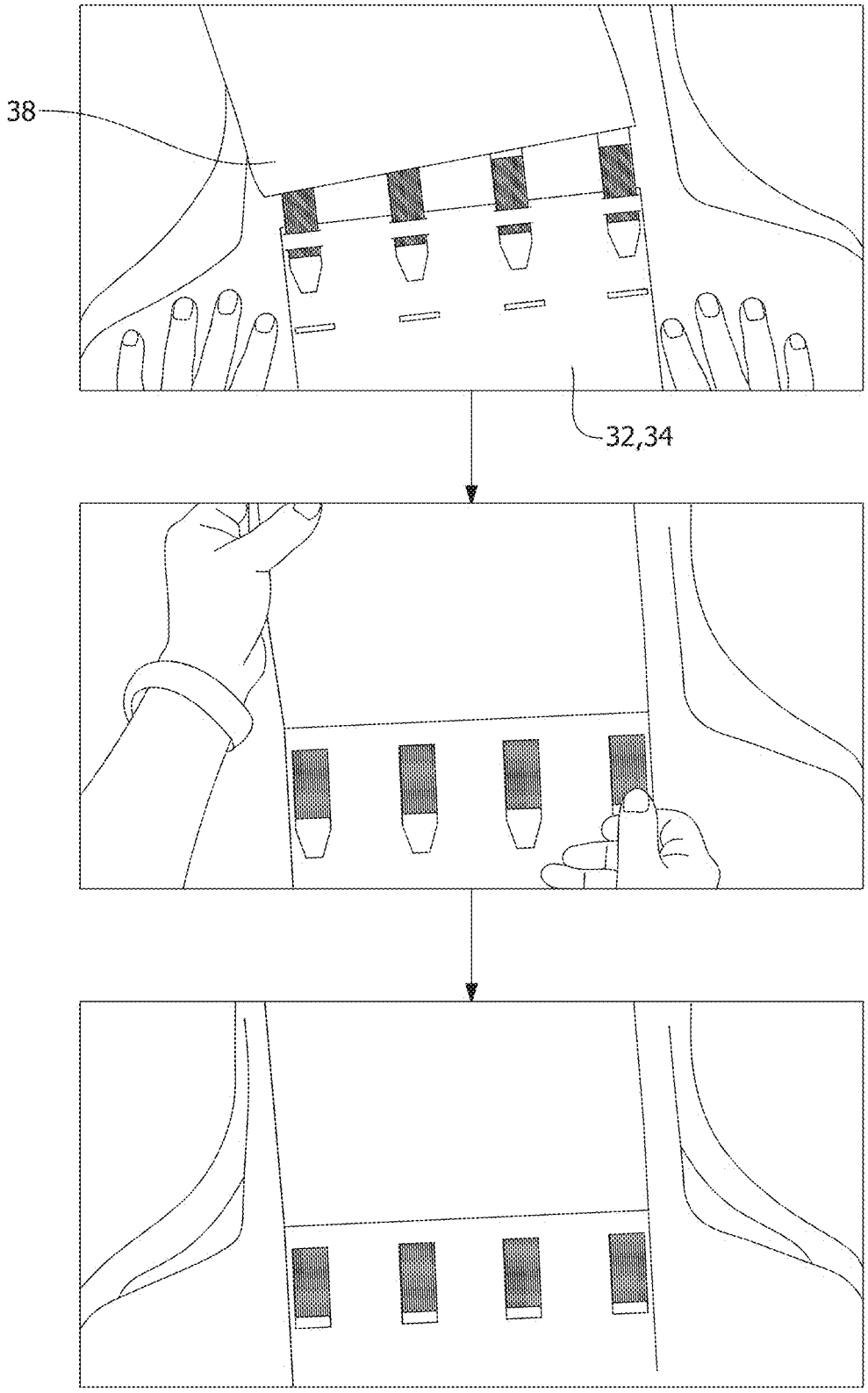
FIGS. 24 and 25 are illustrations of a method of attaching a Zone B front component panel to the Zone B attachment area.
Figure 25:
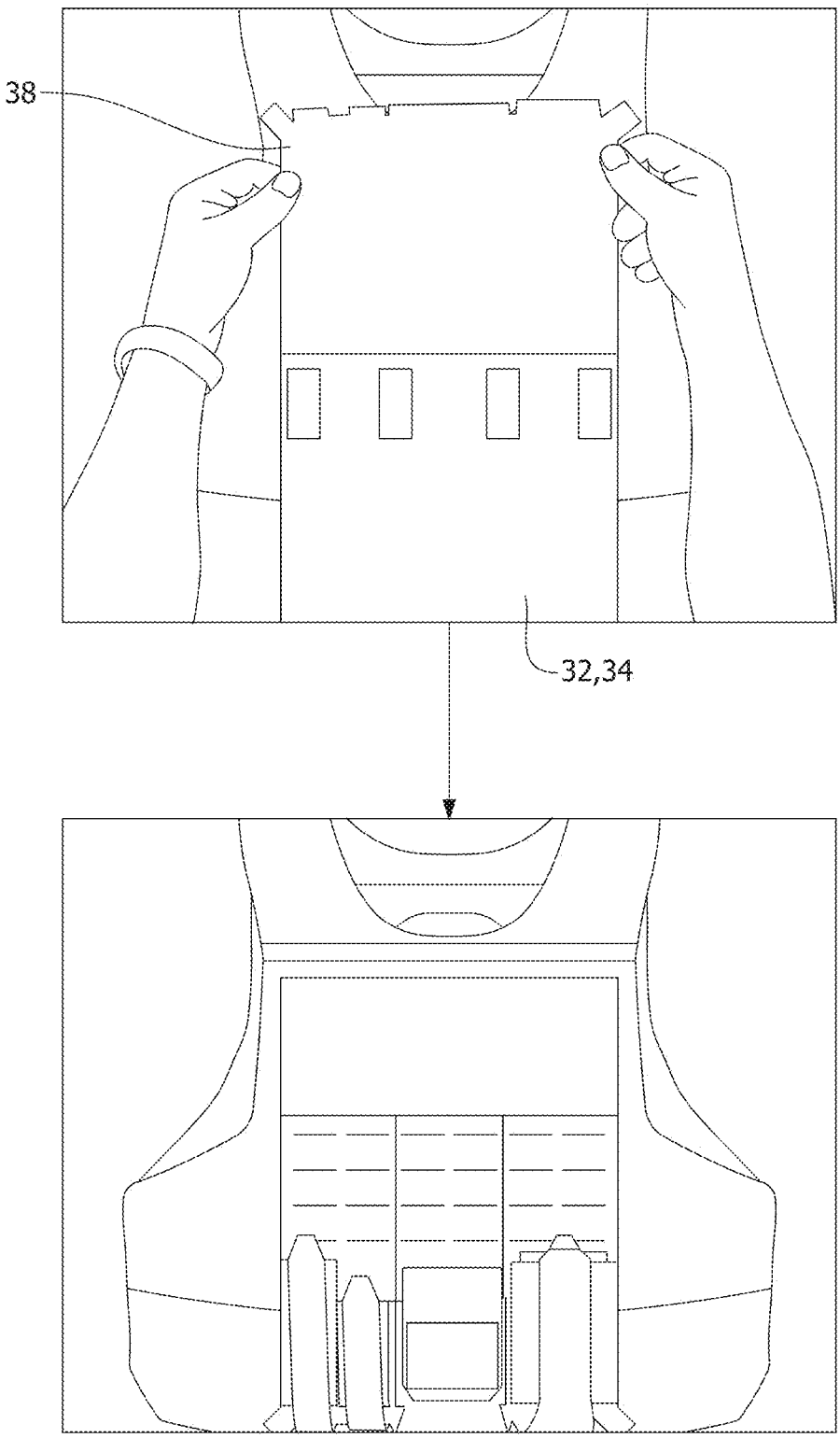
Figure 26:
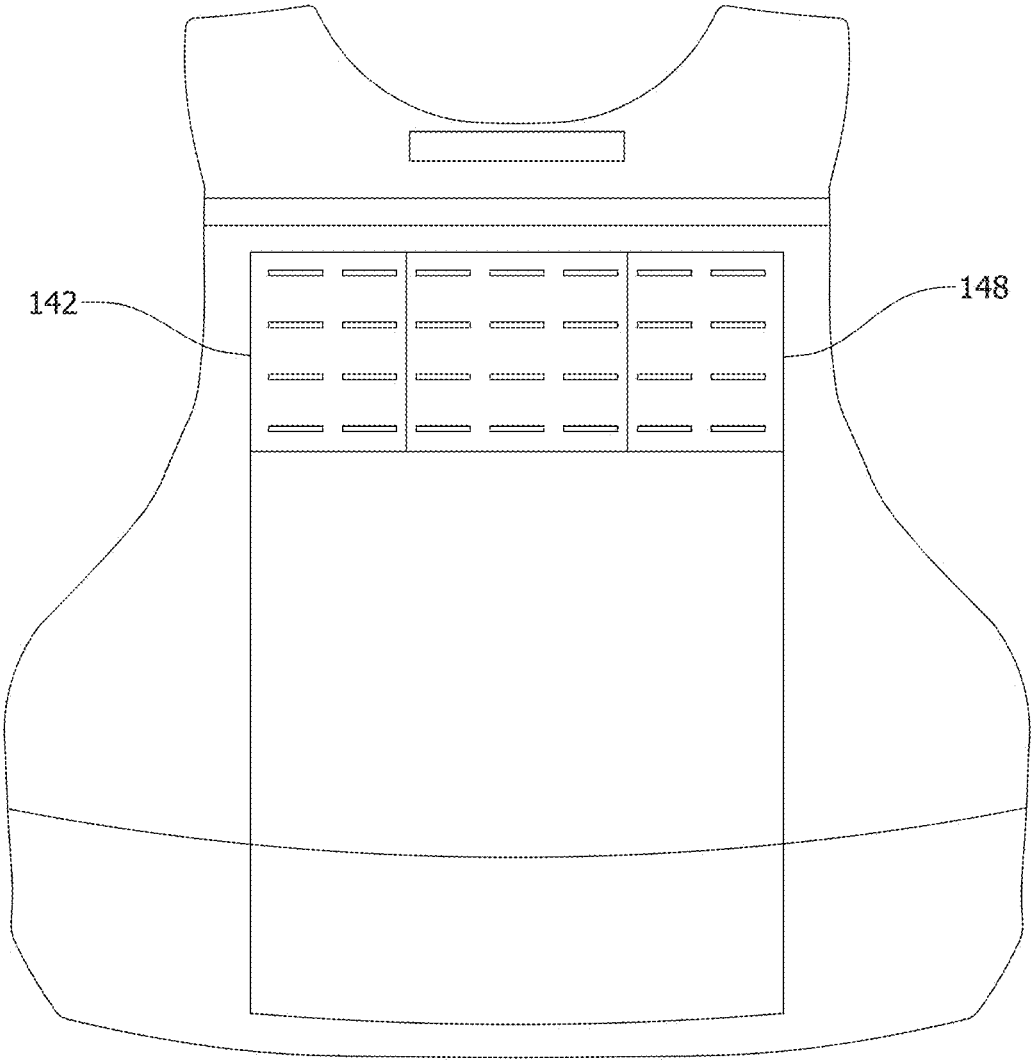
FIG. 26 is a partial perspective view of the rear vest panel with a Zone C rear component panel attached to the Zone C attachment area.
Figure 27:
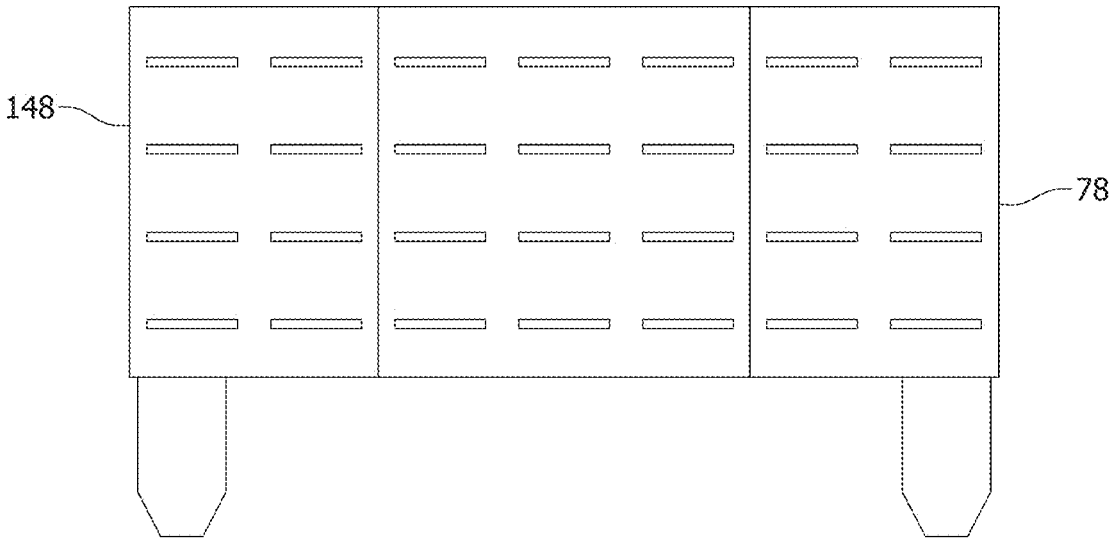
FIG. 27 is front view of a Zone C rear component panel.
Figure 28:
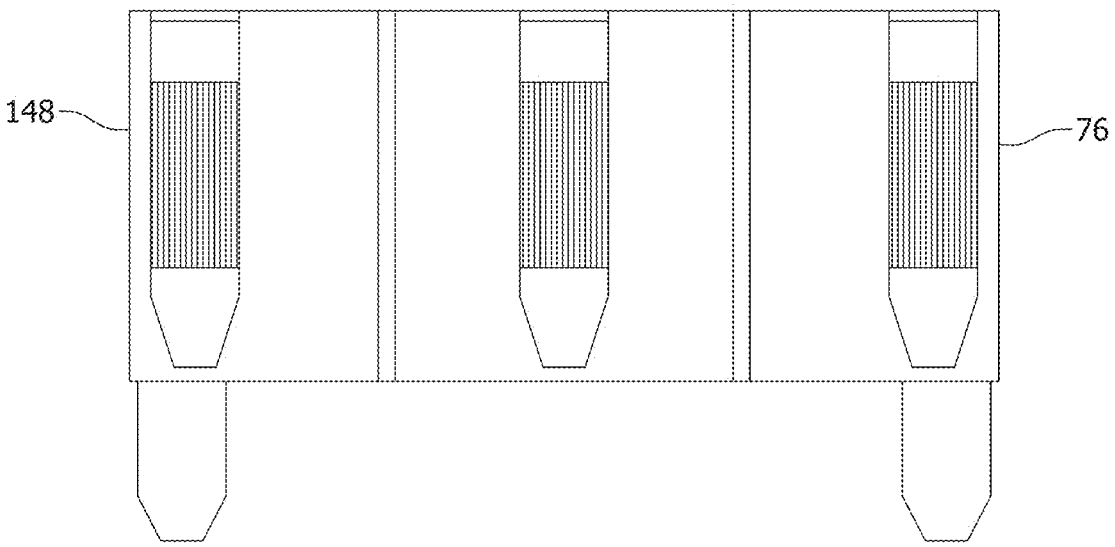
FIG. 28 is rear view of the Zone C rear component panel.
Figure 29:
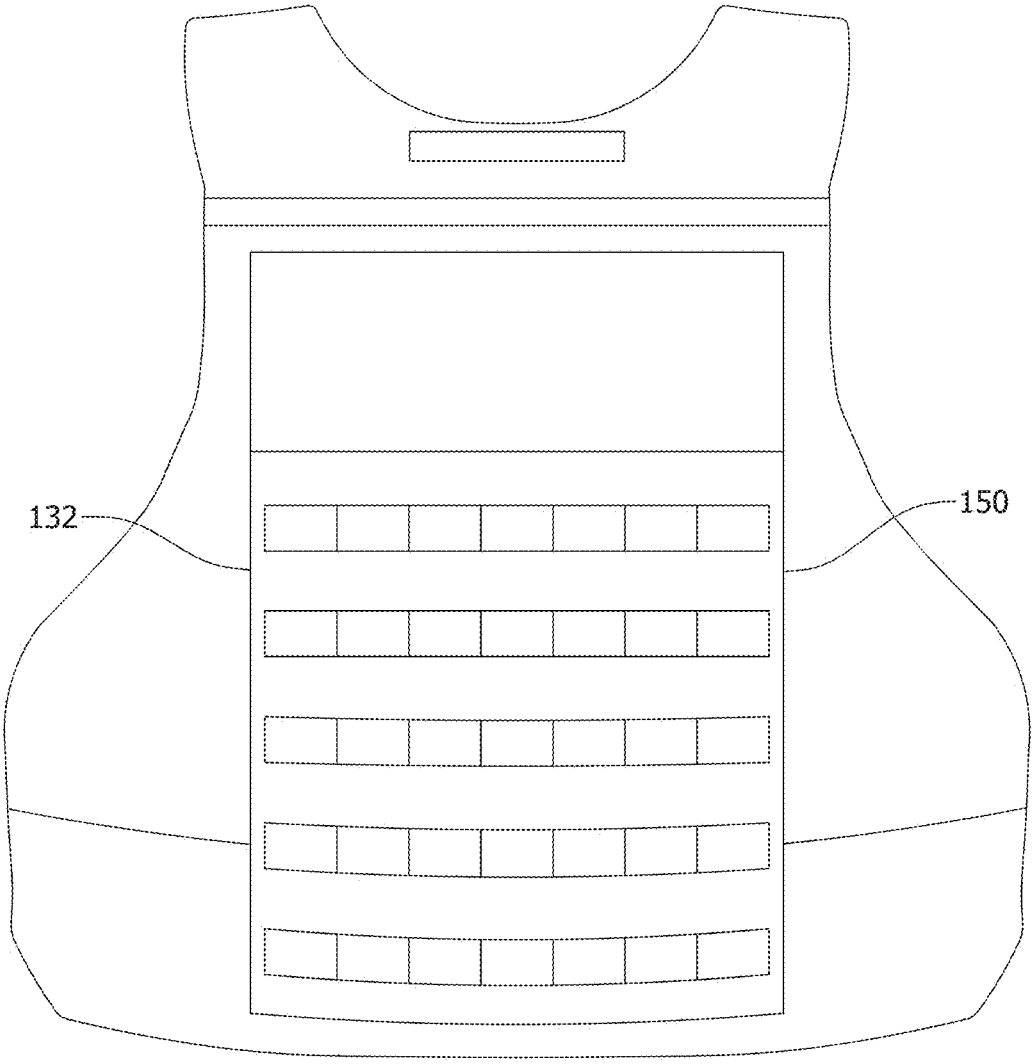
FIG. 29 is a partial perspective view of the rear vest panel with a Zone D rear component panel attached to the Zone D attachment area.
Figure 30:
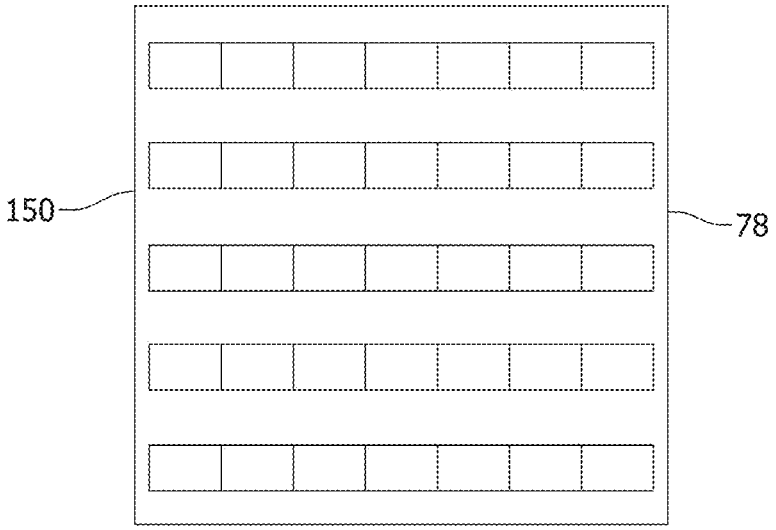
FIG. 30 is front view of a Zone D rear component panel.
Figure 31:
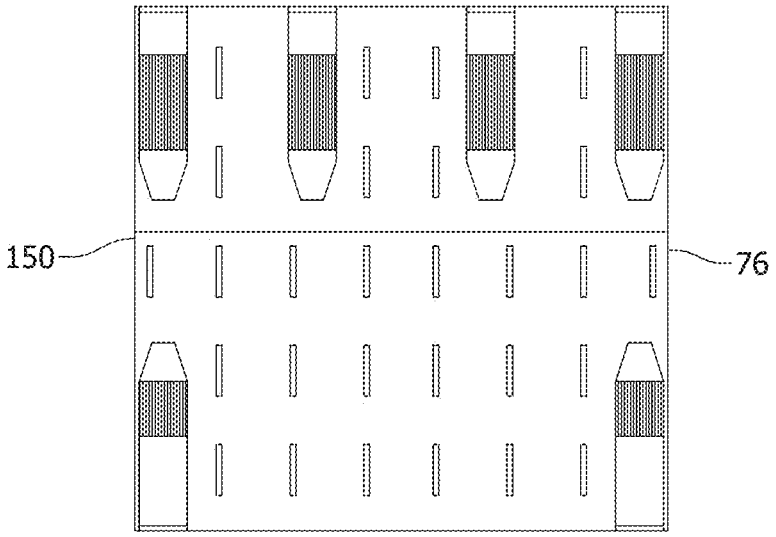
FIG. 31 is rear view of the Zone D rear component panel.

As shown in FIG. 13, when fastened to the rear component attachment panel 34, the Zone C rear component panel 148 and the Zone D rear component panel 150 overlay a full extent of the rear component attachment panel 34.

Obviously, many modifications and variations of the present invention are possible in light of the above teachings. The invention may be practiced otherwise than as specifically described within the scope of the appended claims.

Although specific features of various embodiments of the disclosure may be shown in some drawings and not in others, this is for convenience only. In accordance with the principles of the disclosure, any feature of a drawing or other embodiment may be referenced and/or claimed in combination with any feature of any other drawing or embodiment.

This written description uses examples to describe embodiments of the disclosure and also to enable any person skilled in the art to practice the embodiments, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A personal protective vest assembly to be worn by a wearer comprising:

a front vest panel adapted to overlay a chest of the wearer;

a rear vest panel removably coupled to the front vest panel and adapted to overlay a back of the wearer; and a component attachment system including:

a front component attachment panel coupled to an outer surface of the front vest panel, the front component attachment panel including:

a front attachment panel body having a substantially rectangular shape extending between a top edge and a bottom edge along a longitudinal axis, and between a first side edge and an opposite second side edge along a transverse axis;

a first hook & loop attachment material defined along an outer surface of the front attachment panel body between the top edge, the bottom edge, the first side edge, and the opposite second side edge; and a plurality of attachment slot assemblies defined along the first hook & loop attachment material, each attachment slot assembly including a pair of positioning slots and a retention slot spaced a distance from the pair of positioning slots along the longitudinal axis; and a front component panel removably coupled to the front component attachment panel and including:

a component body having a substantially rectangular shape including an attachment side including a second hook & loop attachment material and an opposite outwardly facing component side including at least one equipment component; and a plurality of retaining tabs hingeably coupled to a top portion of the attachment side and spaced along the transverse axis;

wherein the front component panel is coupled to the front component attachment panel such that each retaining tab is weaved through a corresponding attachment slot assembly and the second hook & loop attachment material of the front component panel is fastened to the first hook & loop attachment material of the front component attachment panel.

2. The personal protective vest assembly of claim 1, wherein each retaining tab includes:

a semi-rigid tab body extending along the longitudinal axis between a top end and a bottom end defining a positioning section adjacent the top end, a locking section adjacent the bottom end, and an attachment section defined between the positioning section and the locking section;

a third hook & loop attachment material defined along an outer surface of the attachment section and configured to couple the attachment section to the first hook & loop attachment material of the front component attachment panel; and a fourth hook & loop attachment material defined along an inner surface of the attachment section and configured to couple the attachment section to the second hook & loop attachment material of the front component panel;

wherein each retaining tab is weaved through the corresponding attachment slot assembly such that the positioning section is orientated adjacent the pair of positioning slots underneath the front component attachment panel, the attachment section is orientated between the pair of positioning slots and the retention slot such that the third hook & loop attachment material fastens to the first hook & loop attachment material of the front component attachment panel and the fourth hook & loop attachment material fastens to the second hook & loop attachment material of the front component panel, and the locking section is inserted through the retention slot and orientated underneath the front component attachment panel.

3. The personal protective vest assembly of claim 1, wherein the component attachment system includes:

a Zone A attachment area defined along an upper portion of the front attachment panel body including a first group of attachment slot assemblies spaced along the transverse axis;

a Zone B attachment area defined along a lower portion of the front attachment panel body and including a second group of attachment slot assemblies spaced along the transverse axis;

a Zone A front component panel removably coupled to the Zone A attachment area; and a Zone B front component panel removably coupled to the Zone B attachment area.

4. The personal protective vest assembly of claim 3, wherein the Zone A attachment area includes three attachment slot assemblies spaced along the transverse axis and the Zone A front component panel includes three retaining tabs corresponding to the three attachment slot assemblies of the Zone A attachment area.

5. The personal protective vest assembly of claim 4, wherein the Zone A front component panel includes a pair of locking tabs extending from a bottom portion of the component body configured to be inserted through corresponding positioning slots of the second group of attachment slot assemblies of the Zone B attachment area.

6. The personal protective vest assembly of claim 4, wherein, the Zone B attachment area includes four attachment slot assemblies spaced along the transverse axis; and the Zone B front component panel includes four retaining tabs corresponding to the four attachment slot assemblies of the Zone B attachment area.

7. The personal protective vest assembly of claim 6, wherein the Zone A front component panel and the Zone B front component panel each have a component width defined along the transverse axis that is substantially equal to a width of the front component attachment panel.

8. The personal protective vest assembly of claim 7, wherein the Zone A front component panel has a first component length defined along the longitudinal axis, and the Zone B front component panel has a second component length defined along the longitudinal axis that is longer than the first component length of the Zone A front component panel.

9. The personal protective vest assembly of claim 8, wherein the Zone A front component panel and the Zone B front component panel overlay a full extent of the front component attachment panel.

10. The personal protective vest assembly of claim 1, wherein the component attachment system includes:

a rear component attachment panel coupled to an outer surface of the rear vest panel and including:

a rear attachment panel body having a substantially rectangular shape;

a rear hook & loop attachment material defined along an outer surface of the rear attachment panel body;

a Zone C attachment area defined along an upper portion of the rear attachment panel body including three attachment slot assemblies spaced along the transverse axis; and a Zone D attachment area defined along a lower portion of the rear attachment panel body and including four attachment slot assemblies spaced along the transverse axis;

a Zone C rear component panel removably coupled to the Zone C attachment area and including three retaining tabs corresponding to the three attachment slot assemblies of the Zone C attachment area; and a Zone D rear component panel removably coupled to the Zone D attachment area and including four retaining tabs corresponding to the four attachment slot assemblies of the Zone D attachment area.

11. The personal protective vest assembly of claim 10, wherein the rear component attachment panel includes a pair of lower rear panel retention slots defined along a bottom edge of the rear hook & loop attachment material; and the Zone D rear component panel includes a pair of lower retaining tabs hingeably coupled to a bottom end of the Zone D rear component panel and configured to be inserted through the pair of lower rear panel retention slots.

12. The personal protective vest assembly of claim 10, wherein the Zone C rear component panel and the Zone D rear component panel each have a component width defined along the transverse axis that is substantially equal to a width of the rear component attachment panel.

13. The personal protective vest assembly of claim 12, wherein the Zone C rear component panel has a first component length defined along the longitudinal axis, and the Zone D rear component panel has a second component length defined along the longitudinal axis that is longer than the first component length of the Zone C front component panel.

14. The personal protective vest assembly of claim 13, wherein the Zone C rear component panel and the Zone D rear component panel overlay a full extent of the rear component attachment panel.

15. A component attachment system for use with a personal protective vest, comprising:

a component attachment panel coupled to an outer surface of the personal protective vest, the component attachment panel including:

an attachment panel body having a substantially rectangular shape extending between a top edge and a bottom edge along a longitudinal axis, and between a first side edge and an opposite second side edge along a transverse axis;

a first hook & loop attachment material defined along an outer surface of the attachment panel body between the top edge, the bottom edge, the first side edge, and the opposite second side edge; and a plurality of attachment slot assemblies defined along the first hook & loop attachment material, each attachment slot assembly including a pair of positioning slots and a retention slot spaced a distance from the pair of positioning slots along the longitudinal axis; and a component panel removably coupled to the component attachment panel and including:

a component body having a substantially rectangular shape including an attachment side including a second hook & loop attachment material and an opposite outwardly facing component side including at least one equipment component; and a plurality of retaining tabs hingeably coupled to a top portion of the attachment side and spaced along the transverse axis;

wherein the component panel is coupled to the component attachment panel such that each retaining tab is weaved through a corresponding attachment slot assembly and the second hook & loop attachment material of the component panel is fastened to the first hook & loop attachment material of the component attachment panel.

16. The component attachment system of claim 15, wherein each retaining tab includes:

a semi-rigid tab body extending along the longitudinal axis between a top end and a bottom end defining a positioning section adjacent the top end, locking section adjacent the bottom end, and an attachment section defined between the positioning section and the locking section;

a third hook & loop attachment material defined along an outer surface of the attachment section and configured to couple the attachment section to the first hook & loop attachment material of the component attachment panel; and a fourth hook & loop attachment material defined along an inner surface of the attachment section and configured to couple the attachment section to the second hook & loop attachment material of the component panel;

wherein each retaining tab is weaved through the corresponding attachment slot assembly such that the positioning section is orientated adjacent the pair of positioning slots underneath the component attachment panel, the attachment section is orientated between the pair of positioning slots and the retention slot such that the third hook & loop attachment material fastens to the first hook & loop attachment material of the component attachment panel and the fourth hook & loop attachment material fastens to the second hook & loop attachment material of the component panel, and the locking section is inserted through the retention slot and orientated underneath the component attachment panel.

17. The component attachment system of claim 15, wherein the component attachment system includes:

a Zone A attachment area defined along an upper portion of the attachment panel body including a first group of attachment slot assemblies spaced along the transverse axis;

a Zone B attachment area defined along a lower portion of the attachment panel body and including a second group of attachment slot assemblies spaced along the transverse axis;

a Zone A component panel removably coupled to the Zone A attachment area; and a Zone B component panel removably coupled to the Zone B attachment area.

18. The component attachment system of claim 17, wherein the Zone A attachment area includes three attachment slot assemblies spaced along the transverse axis and the Zone A component panel includes:

three retaining tabs corresponding to the three attachment slot assemblies of the Zone A attachment area; and a pair of locking tabs extending from a bottom portion of the component body configured to be inserted through corresponding positioning slots of the second group of attachment slot assemblies of the Zone B attachment area.

19. The component attachment system of claim 18, wherein, the Zone B attachment area includes four attachment slot assemblies spaced along the transverse axis; and the Zone B component panel includes four retaining tabs corresponding to the four attachment slot assemblies of the Zone B attachment area.

20. The component attachment system of claim 19, wherein the Zone A component panel and the Zone B component panel each have a component width defined along the transverse axis that is substantially equal to a width of the component attachment panel;

wherein the Zone A component panel has a first component length defined along the longitudinal axis, and the Zone B component panel has a second component length defined along the longitudinal axis that is longer than the first component length of the Zone A component panel; and wherein the Zone A component panel and the Zone B component panel overlay a full extent of the component attachment panel.

* * * * *